United States Patent [19]

Whately et al.

[11] Patent Number: 4,726,471

[45] Date of Patent: Feb. 23, 1988

[54] SACHET PACKAGE

[75] Inventors: Richard V. Whately, Wirral; Ronald M. Sweeney, West Kirkby, both of England

[73] Assignee: Premier Brands U.K. Limited, Birmingham, England

[21] Appl. No.: 849,488

[22] Filed: Apr. 8, 1986

[51] Int. Cl.[4] ..... B65D 5/56; B65D 5/66

[52] U.S. Cl. ..... 206/554; 206/624; 220/416; 229/44 CB

[58] Field of Search ..... 206/264, 268, 273, 611, 206/624, 807, 621, 554, 526; 220/416, 453, 415; 229/44 CB

[56] References Cited

U.S. PATENT DOCUMENTS

| | | | |
|---|---|---|---|
| 2,046,485 | 7/1936 | Ringler | 206/264 X |
| 2,178,967 | 11/1939 | Markert | 206/624 X |
| 2,262,803 | 11/1941 | Huffield | 206/624 |
| 2,464,065 | 3/1949 | Zinn, Jr. | 220/453 X |
| 2,579,443 | 12/1951 | Snyder | 206/497 X |
| 2,789,746 | 4/1957 | Hovland | 206/621 X |
| 2,865,498 | 12/1958 | Ringler | 206/268 |
| 2,875,938 | 3/1959 | Bramhill | 206/264 X |
| 3,286,830 | 11/1966 | Robb, Jr. | 206/264 X |
| 3,335,940 | 8/1967 | Dykes | 206/621 X |
| 3,708,108 | 1/1973 | Rosenburg, Jr. | 206/624 X |
| 4,000,811 | 1/1977 | Hardison et al. | 206/624 X |
| 4,141,449 | 2/1979 | Stone | 206/624 X |
| 4,569,475 | 2/1986 | Cassidy | 206/624 X |
| 4,650,075 | 3/1987 | Grazia | 206/554 |

FOREIGN PATENT DOCUMENTS

| | | | |
|---|---|---|---|
| 530030 | 9/1956 | Canada | 220/416 |
| 186962 | 10/1922 | United Kingdom | 220/416 |
| 590524 | 2/1945 | United Kingdom | 229/14 |

*Primary Examiner*—Stephen Marcus
*Assistant Examiner*—T. Graveline
*Attorney, Agent, or Firm*—Popper, Bobis & Jackson

[57] ABSTRACT

The invention describes the package of cut and creased sheet material for receiving stacks of tea bags. The package is erected to a receiving position by folding and gluing the cut and creased blank to define an intermediate position of the package in which a side is open for the reception of the tea bags. After insertion of the tea bags, the side is closed by means of a closure panel glued to the remainder of the package. The thus sealed package also has defined therein at one end a flip top type lid which can be broken open giving access to the package contents. The invention also provides a method of inserting tea bags into the package followed by the closing of same to provide a sealed unit.

1 Claim, 6 Drawing Figures

SACHET PACKAGE

This invention relates to the packaging of sachets such as tea bags, and in particular concerns a novel form of package for such sachets, and a method of packaging sachets.

For convenience, reference is made hereinafter only to tea bags, but the contents of the bags does not affect the scope of the invention.

Currently, tea bags generally are packaged in stacks by a machine which takes a stack of the tea bags and inserts the stack into the open top of a box container constructed from a blank of cut and creased sheet material. The container has an integral lid which is folded over and tucked into position in order to close the contaienr ready for distribution.

With existing equipment, it is not possible reliably to insert stacks of single tea bags in the container, and therefore, for the reasons described in United Kingdom Application No. 8408163, the stacks of tea bags are inserted in pairs i.e. the respective tea bags in one stack are respectively connected to their neighboring tea bags in an adjacent stack.

As outlined in the above-mentioned application however, we have invented means for producing stacks of single tea bags, and the present invention is concerned with a novel form of package for receiving the stacks of singles tea bags, although it is to be pointed out that this invention can be used in connection with existing technology equipment which performs the insertion of the tea bags in pairs.

The package according to the present invention is constructed from a cut and creased blank of sheet material, such as cardboard, and the package is erected to a tea bag receiving position in which the package is generally box shaped defining two larger faces and narrower sides, one of the faces being open to enable the insertion of stacks of tea bags into the container, and the package including a face panel which after insertion of the tea bags can be folded over to close the open face, the package further comprising lines of weakening and fold lines defining a flip top end which can be broken open and folded clear of an end of the container to gain access to the tea bags.

If the tea bags are stacked into the containers to that they lie face on relative to the larger side faces of the container, then when the container is subsequently opened to gain access to the tea bags by breaking open the flip top end, then the tea bags will be presented edge on to the consumer, and this facilitates removal of the tea bags, especially when the tea bags are in stacks of singles.

The container may be placed in the sealed condition by the respective parts being glued to one another during erection thereof so that the container is in fact tamperproof. This obviates the need for using any additional shrink wrapping or cellophane covering material, although these can be used for example in cases where moisture control is required.

The blank is preferably of cut and creased cardboard material.

The invention also provides a method for the packaging of stacks of tea bags, wherein the tea bags are inserted in stacks in a package according to the invention through a larger side face thereof, with the tea bags face on in relation to the larger faces of the package, the package being sealed to contain the tea bags which can be accessed by the breaking open of the flip top of the package.

An embodiment of the invention will now be described, by way of example, with reference to the accompanying drawings, wherein.

Figure 1:
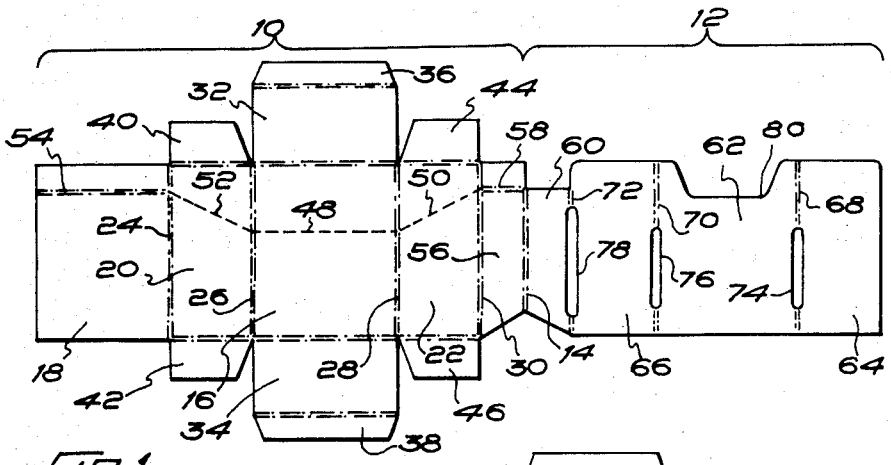
FIG. 1 is a plan view of a blank for providing a container according to the invention.

Referring to FIG. 1, a blank for producing a container according to the invention is shown, and the drawing adopts the convention of showing cut lines or edges in full lines, and crease lines in double chain dotted lines.

The blank defines an outer case section 10 and an inner liner section 12, the respective sections being connected by a crease line 14.

The outer case section or panel means comprises two main face panels 16 and 18, and narrower side or edge panels 20 and 22, these being connected by the crease or hinge lines 24, 26, 28 and 30. Hinged to the ends of main face panel 16 are end panels 32 and 34 which in turn have hinged thereto tuck in glue tabs 36 and 38.

There are glue tabs 40, 42, 44 and 46 hinged to the ends of the panels 20 and 22.

A flip top end cover construction is defined, as will be explained, by means of skip cut lines 48, 50 and 52 respectively in the panels 16, 22 and 20, and face panel 18 has a hinge line 54 defined therein. Outer case 10 finally has a coupling panel 56 which has a hinge line 58 therein in alignment with hinge 54.

The coupling panel 56 is connected to a coupling panel 60 of the inner case panel means or lining section via the hinge line 14, and the remainder of the lining section comprises a main or face panel 62 and two edge or side panels 64 and 66, these panels being connected by hinge lines 68 and 70. Panel 66 is connected to the coupling panel 60 via hinge line 72. There are cut out portions 74, 76 and 78 along tyhe hinge lines 68, 70 and 72 in order to facilitate folding of the respective sections 60, 62, 64 and 66. Coupling panel 60 is of lesser length than the adjoining panel 56 as shown, and the panels 56 and 60 are chamfered at the bottom ends in FIG. 1. The panel 62 is cut away at 80 in order to define an access opening as will be explained hereinafter.

In the erection and utilisation of the blank shown in FIG. 1 the various sections are glued together to provide the sealed package illustrated in FIG. 5, and the erection and filling of the blank will now be explained with reference to the other figures.

Figure 2:
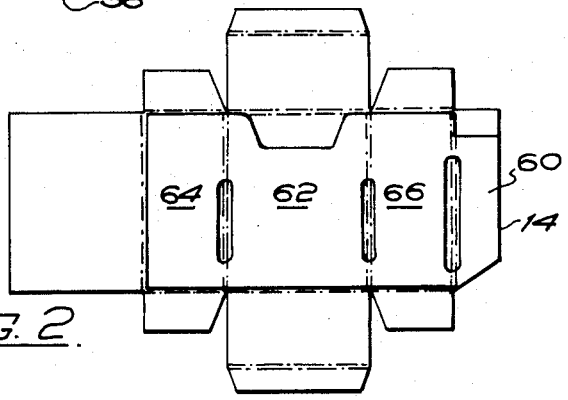
FIGS. 2, 3 and 4 show the blank of FIG. 1 in respect of states of erection.
Figure 3:
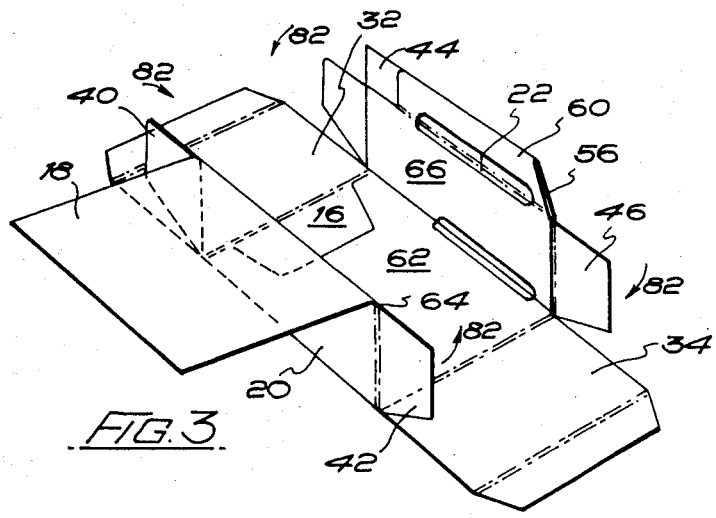

Referring now to FIG. 2, in the first stage of erection, the lining section 12 is folded over onto the outer casing section 10 about hinge line 14, and the coupling panels 56 and 60 where they come face to face are glued together. It will be noticed that the lining panels 62, 64 and 66 overlie the outer case panels 16, 22 and 20, but are dimensioned so as to be slightly shorter and if necessary narrower to permit the subsequent folding operation which will be explained. In the next stage of operation, as shown in FIG. 3, the longer sides of the container are moved to an upright position, and suitably this may be performed by a punch and die type operation. The overlapped panels 16 and 62 remain horizontal whilst the outer case and lining panel pairs, 22 and 66 and 20 and 64 are moved to the vertical position as shown clearly in FIG. 3, the face panel 18 which is connected to the top edge in FIG. 3 of panel 20 being maintained in the horizontal position.

Figure 4:
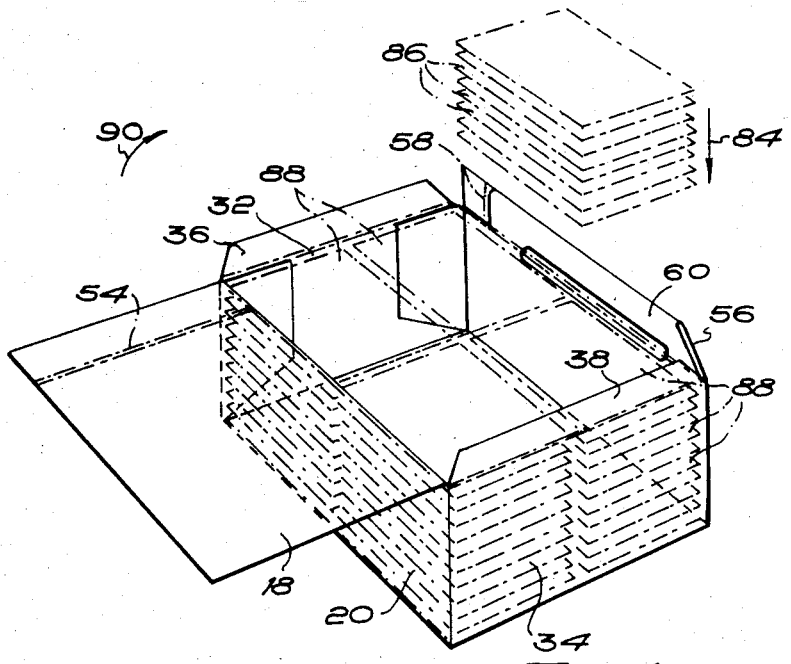

At the same time, the tabs 42, 46, 40 and 44 are tucked inwardly as indicated by the arrow 82 in FIG. 3 and the end panels 32 and 34 are folded upwardly until the position shown in FIG. 4 is reached, the tabs 42, 46, 40 and 44 being glued to the insides of the panels 32 and 34.

The tea bags in stacks are now inserted by machinery into the open upper surface of the containers shown in FIG. 4, in the manner indicated by arrows 84 in that figure. A stack 86 of tea bags is illustrated in a position above the container and ready to be inserted, but the drawing also shows that the container already has inserted therein four stacks 88 of singles tea bags already positioned in the container.

To complete the sealing operation, the glued coupling panels 56 and 60, the glue tabs 38 and 36 are folded inwardly over the tea bags, and then the face panel 18 is folded over as indicated by arrow 90 in FIG. 4 and the panel 18 is glued to the said tabs 36 and 38 and to the outer surface of coupling panels 56. The hinge line 54 in panel 18 overlies the hinge line 58 in the panel 56 and the panel 60 is of shorter length as explained in relation to FIG. 1 in order to permit the hinging of the flip top as will now be described in relation to FIGS. 5 and 6.

Figure 5:
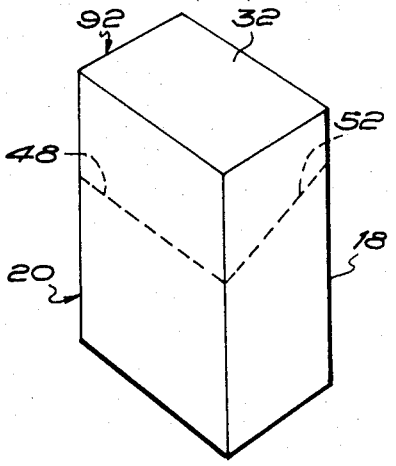
FIG. 5 shows the completed contaienr after the tea bags have been inserted therein and the container sealed.

Referring now to FIG. 5, this shows the completed container 92 after the sealing operation described previously, and when the container has been turned so as to stand on the end panel 34. The skip cut lines 52 and 48 are clearly shown, and the other skip cut line 52 is on the not seen end panel 20, but it lies in a disposition similar to the skip cut line 52. The hinge line 54 extends on the face panel 18 between the ends of skip cut lines 52 and 50.

Figure 6:
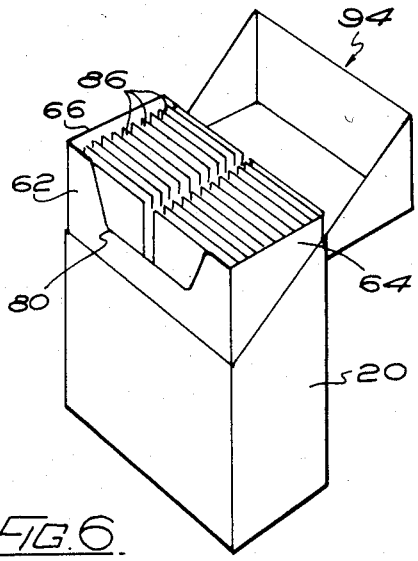
FIG. 6 shows how the flip top of the container is broken away to permit access to the tea bags.

This provides that the container shown in FIG. 5 can be opened by breaking the flip top cover 94 along the break lines 48, 50 and 52, and the cover can hinge along the hinge line 54 and also along the hinge line 58, as the portion of panel 56 above hinge line 58 in FIG. 1 will be adhered to the surface of the hingeable part of panel 18. As shown in FIG. 6, the tea bags 86 are presented edge on for removal individually by the consumer. The package can of course be re-closed by hinging the cover 94 back to the FIG. 5 position.

The package in the FIG. 5 position may additionally be wrapped in a Cellophane (Trade Mark) or like film with a suitable tear strip, and in a modified method of packaging, prior to the application of the film the break lines 52 may be broken by a suitable means acting on the package by pressing on the sides 20, 22 adjacent in break lines 52 so that the user, after remvoing the film, only has to break the package along line 48 to open the flip top lid.

It can be seen that the lining panels 62, 64 and 66 are located towards the front of the container forming a retention means for the tea bags 86, and a cut away portion 80 is also at the front of the container permitting ready access to the tea bags 86.

We claim:

1. A cut and creased blank which is erectible into a package for holding tea bags, comprising:

(a) outer case panel means mae up of rectiliner panels which comprise and are hinged together along hinge lines in the following order:
a first edge panel, a first face panel, a second edge panel and a second face panel;

(b) inner case panel means made up of rectilinear panels which comprise and are hinged together along hinge lines in the following order:
a first edge panel, a first face panel and a second edge panel;

(c) coupling panel means comprising first and second coupling panels of the same width hinged together along a main hinge line and respectively hinged along auxiliary hinge lines to the first edge panels of the outer case panel means and the inner case panel means,
all of said main hinge line, auxiliary hinge lines and hinge lines connecting the outer case panel means and connecting the inner case panel means being parallel;

(d) end panels hinged to the ends of the first face panel of the outer case panel means;

(e) glue tabs hinged to the ends of the first and second edge panels of the outer case panel means;

(f) a flip top hinge line in said second face panel of the outer case panel means; and (g) lines of weakening in the first edge panel, the first face panel, and the second edge panel of the outer case panel means to define with the adjacent end panel a flip top lid;
said blank being erectible by folding about said main hinge line so that the first and second coupling panels come face to face as do the outer case and inner case panel means, so that the first edge panels, the first face panels and the second edge panels of the outer and inner case panel means come face to face, followed by folding of the face to face first and second edge panels at right angles to the face to face first panels of the outer case panel means and the inner case panel means, followed by tucking and glueing of the glue tabs and end panels, followed, after filling the resulting package with the contents, by folding of the face to face coupling panels inwardly and by folding of the second face panel to close the package by being gluded to the inwardly folded coupling panels, the resulting package being openable by fracturing same along said lines of weakening to enable the said flip top lid to be hinged open and closed about said flip top hinge line.

* * * * *